US005349839A

United States Patent [19]

Weykamp et al.

[11] Patent Number: 5,349,839

[45] Date of Patent: Sep. 27, 1994

[54] FLEXIBLE CONSTRAINING APPARATUS AND METHOD FOR THE STRETCH FORMING OF ELONGATED HOLLOW METAL SECTIONS

[75] Inventors: Robert E. Weykamp, Plum Boro; Robert P. Evert, Allison Park, both of Pa.

[73] Assignee: Aluminum Company of America, Pittsburgh, Pa.

[21] Appl. No.: 43,014

[22] Filed: Apr. 5, 1993

[51] Int. Cl.[5] ..... B21D 11/02; B21D 26/02

[52] U.S. Cl. ..... 72/296; 72/61; 72/466

[58] Field of Search ..... 72/296, 297, 58, 57, 72/61, 62, 466, 465, 482

[56] References Cited

U.S. PATENT DOCUMENTS

| | | | |
|---|---|---|---|
| 2,267,774 | 12/1941 | Wall | 72/465 |
| 2,693,637 | 11/1954 | Peabody et al. | 29/550 |
| 2,729,265 | 1/1956 | Jones | 153/32 |
| 2,868,264 | 1/1959 | Jones | 153/51 |
| 2,889,864 | 6/1959 | Bowser | 72/297 |
| 4,567,743 | 2/1986 | Cudini | 72/61 |
| 4,803,878 | 2/1989 | Moroney | 72/296 |
| 5,070,717 | 12/1991 | Boyd et al. | 72/55 |
| 5,107,693 | 4/1992 | Olszewski et al. | 72/58 |
| 5,214,951 | 6/1993 | Waddell | 72/297 |

*Primary Examiner*—Daniel C. Crane

*Attorney, Agent, or Firm*—John I. Iverson; Thomas R. Trempus

[57] ABSTRACT

Disclosed is apparatus and methods for the stretch forming of an elongated hollow metal section, such as an aluminum extrusion. The apparatus and methods use a flexible constraining means which surrounds at least a portion of the outer periphery of the elongated hollow metal section to constrain and support the walls of the elongated hollow metal section against the forces produced within the interior of the hollow metal section during the reshaping of the extrusion by the stretch forming operation. The apparatus and methods disclosed herein resist wrinkles, crimps and bulges being formed in the walls of the elongated hollow metal section during the stretch forming and reshaping thereof.

10 Claims, 3 Drawing Sheets

FLEXIBLE CONSTRAINING APPARATUS AND METHOD FOR THE STRETCH FORMING OF ELONGATED HOLLOW METAL SECTIONS

BACKGROUND OF THE INVENTION

This invention relates to apparatus and methods for the forming of elongated hollow metal sections into a predetermined shape or contour. It relates particularly to apparatus and methods for the bending or reshaping of elongated hollow metal sections, such as aluminum extrusions, using "stretch forming" apparatus and methods. The stretch forming process for bending or shaping of an aluminum extrusion involves placing the ends of the elongated hollow extrusion into an opposed pair of jaws or clamps attached to a pair of opposed hydraulic cylinders and then applying sufficient tension through the hydraulic cylinders and jaws or clamps on the ends of the extrusion to "stretch" the metal in the extrusion beyond its yield point or elastic limit. While the metal is tensioned above the elastic limit, a forming die of desired shape and contour is pressed against the extrusion causing the extrusion to assume the desired shape and contour of the forming die. The tension on the ends of the extrusion is then reduced and the newly shaped extrusion is removed from the forming die and the stretch forming apparatus.

In the past, the stretch forming of elongated hollow metal sections, and especially thin walled aluminum extrusions, often produced crimps or wrinkles in certain portions of the sections or extrusion walls as a result of the inability of the walls of the section or extrusion to resist the reshaping forces during the stretch forming operation. Such crimps and wrinkles not only weakened the final section, but also resulted in an extrusion of unacceptable appearance.

While in some cases the crimps and wrinkles could be eliminated by using a thicker walled section, such a solution added to the cost of the finished product and increased its weight. U.S. Pat. No. 4,803,878 issued Feb. 14, 1989 to Moroney not only discloses the above-described process for stretch forming of elongated hollow metal sections or extrusions, but also discloses one proposed solution to eliminate the crimps and wrinkles formed in the shaping of thin walled extrusions. Moroney suggests that the crimps and wrinkles can be reduced or eliminated by introducing a gas under pressure into the interior of the elongated hollow metal section or extrusion while it is being stretch formed. Moroney claims that the internal gas pressure is sufficient to support the internal walls of the extrusion during the stretch forming operation and will prevent the formation of crimps and wrinkles. While the use of an internal pressurized gas has helped to reduce the formation of crimps and wrinkles, the use of the internal pressurized gas alone has not completely eliminated the crimps and wrinkles and in some instances, produced bulging of the thin walls of the hollow metal section or extrusion and again resulting in an unacceptable finished product.

SUMMARY OF THE INVENTION

It is therefore an object of this invention to provide apparatus and methods useful for the stretch forming of elongated hollow metal sections which will resist the crimping, wrinkling or bulging of the elongated hollow metal section.

It is another object of this invention to provide apparatus and methods that allow the stretch forming of elongated hollow metal sections into a finished product having accurate dimensions, contours and a smooth appearance.

It is still another object of this invention to provide apparatus and methods for the stretch forming of elongated hollow metal sections that can be easily adapted to existing stretch forming equipment and manufacturing practices.

It is another object of this invention to provide apparatus and methods for the stretch forming of elongated hollow metal sections that can be adapted for the forming and shaping of a wide variety of cross-sections of elongated hollow metal sections and extrusions.

We have discovered that the foregoing objects can be attained by providing apparatus and methods for the stretch forming of an elongated hollow metal section into a predetermined contour comprising means to grip the opposed ends of the elongated hollow metal section, a forming die member having a forming die face and a die cavity in the die face adapted to receive the elongated hollow metal section and a flexible constraining means. The apparatus and methods include means to tension the elongated hollow metal section above its elastic limit. The apparatus and methods of this invention include a flexible constraining means which surrounds at least a portion of the outer periphery of the elongated hollow metal section and which is adapted to constrain the external surfaces of the elongated hollow metal section while is contained in the die cavity during the tensioning thereof.

DESCRIPTION OF THE PREFERRED EMBODIMENTS

Figure 1:
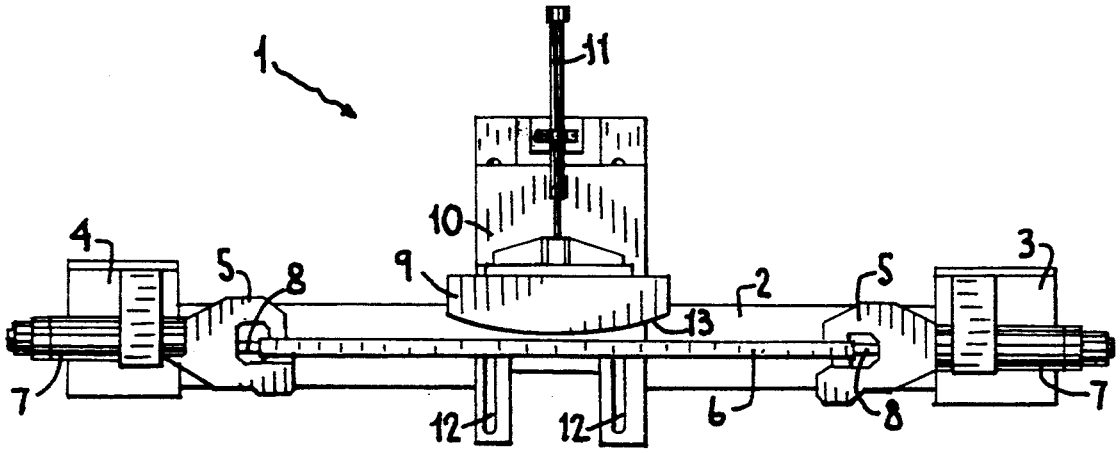
FIG. 1 is a top plan view of a typical stretch forming apparatus used to reshape elongated hollow metal sections and illustrating the apparatus with a hollow metal section in the apparatus prior to the stretch forming operation.
Figure 2:
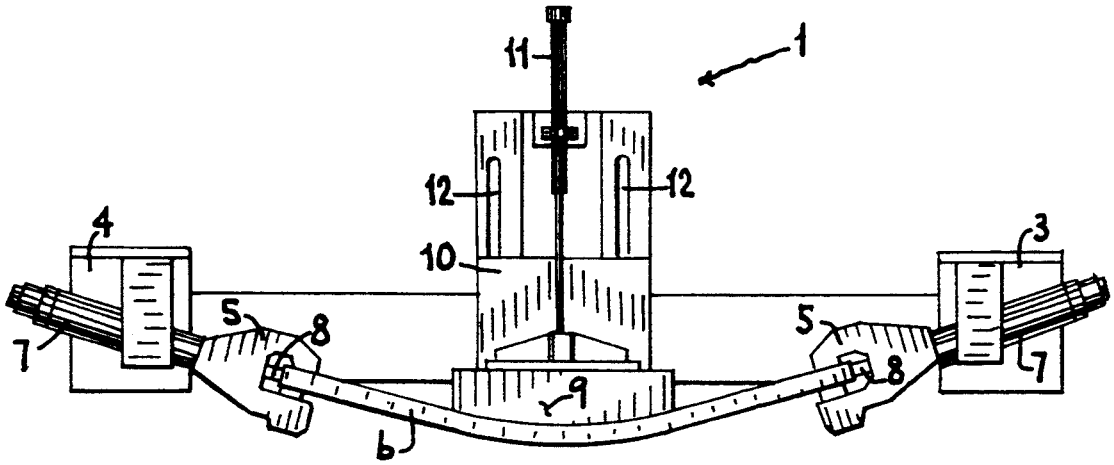
FIG. 2 is a top plan view of the same stretch forming apparatus shown in FIG. 1, illustrating the hollow metal section as it is being stretch formed by the forming die while the metal in the hollow metal section is tensioned above its elastic limit.

FIGS. 1 and 2 illustrate a typical apparatus and methods used to stretch form an elongated hollow metal section, such as an aluminum extrusion. As shown in FIGS. 1 and 2, the stretch forming apparatus 1 comprises an elongated foundation bed or table 2 having a pair of carriages 3 and 4 at each end of the bed or table 2. The carriages 3 and 4 are positioned on the bed or table 2 a suitable distance apart for the length of the extrusion to be stretch formed and then locked into place. The carriages 3 and 4 do not move during the stretch forming operation.

Each of the carriages 3 and 4 is equipped with a clamp or jaws 5 which are designed to tightly grip and hold the ends of the extrusion 6 to be reshaped and stretch formed. Each of the carriages 3 and 4 are also provided with hydraulic pistons and cylinders 7 to provide a tensioning force to the ends of the extrusion 6 when gripped in the clamps or jaws 5.

In a preferred version of the stretch forming apparatus 1, as further described in the above-mentioned U.S. Pat. No. 4,803,878 to Moroney, which is incorporated by reference herein, the clamps or jaws 5 are provided with mandrels 8 which are designed to fit tightly into the ends of the extrusion 6 when they are held by the clamps or jaws 5. The mandrels 8 are shaped in a cross-section to conform the cross-section of the interior of the extrusion 6 and are provided with elastomeric seals which provide an airtight seal to the interior of the extrusion 6. Pressurized air is then pumped into the interior of the extrusion 6 through inlets in the mandrels 8 to maintain the interior of the extrusion 6 at a greater than atmospheric pressure during the stretch forming operation.

The stretch forming apparatus 1 is provided with a die member 9 mounted on a movable die carriage 10. The die carriage 10 and the die member 9 are able to be moved transversely to the axis of the foundation bed or table 2 along parallel guide rails 12 by a hydraulic piston and cylinder 11. The die member 9 has a die face portion 13 shaped to provide the desired curve or contour to the extrusion 6 and is usually also provided with a die cavity 14 machined into the die face portion 13, as illustrated in FIG. 3*a*, to accommodate at least a portion of the cross-section of the extrusion 6 be stretch formed.

As shown in FIG. 2, the reshaping or stretch forming of the extrusion 6 is performed by first activating the tension pistons and cylinders 7 attached to the clamps or jaws 5 which tightly hold the ends of the extrusion 6. Enough tension is applied to the ends of the extrusion 6 to exceed the elastic limit of the metal in the extrusion and thereby place the metal in the "yield state" where the metal is susceptible to easy reshaping and forming. Once the metal is tensioned to the "yield state", the die carriage 10 and the die member 9 are moved forward by the hydraulic piston and cylinder 11 along the guides 12 until the die member reshapes the extrusion 6 into the desired contour or shape, as illustrated in FIG. 2. As also illustrated by FIG. 2, the clamps or jaws 5 are permitted to pivot to provide the proper angle tangent to the curve being formed in the extrusion 6.

During the reshaping operation by the die member 9, the air pressure in the interior of the extrusion is maintained a level high enough to resist any forces that would tend to wrinkle or crimp the walls of the extrusion 6.

Figure 3A:
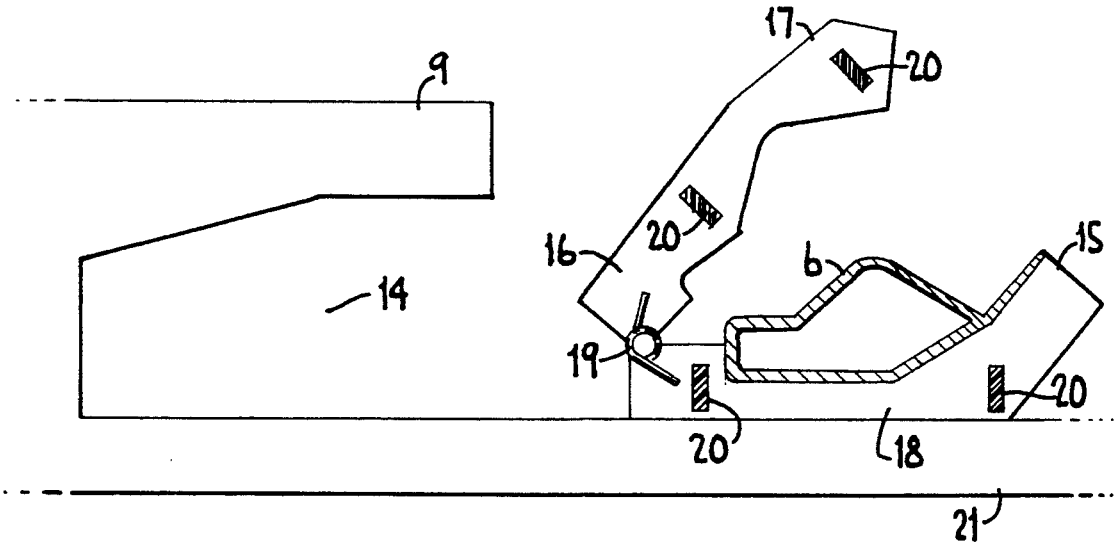
FIG. 3*a* is a side sectional view of a preferred embodiment of the flexible constraining means used in the apparatus of this invention prior to the stretch forming of the hollow metal section.
Figure 3B:
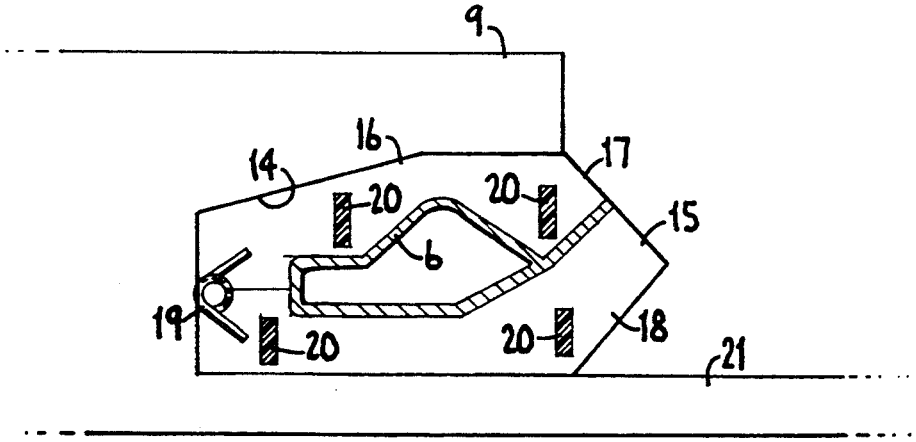
FIG. 3*b* is a side sectional view of the preferred embodiment of the flexible constraining means used in the apparatus of this invention during the stretch forming of the hollow metal section.
Figure 4:
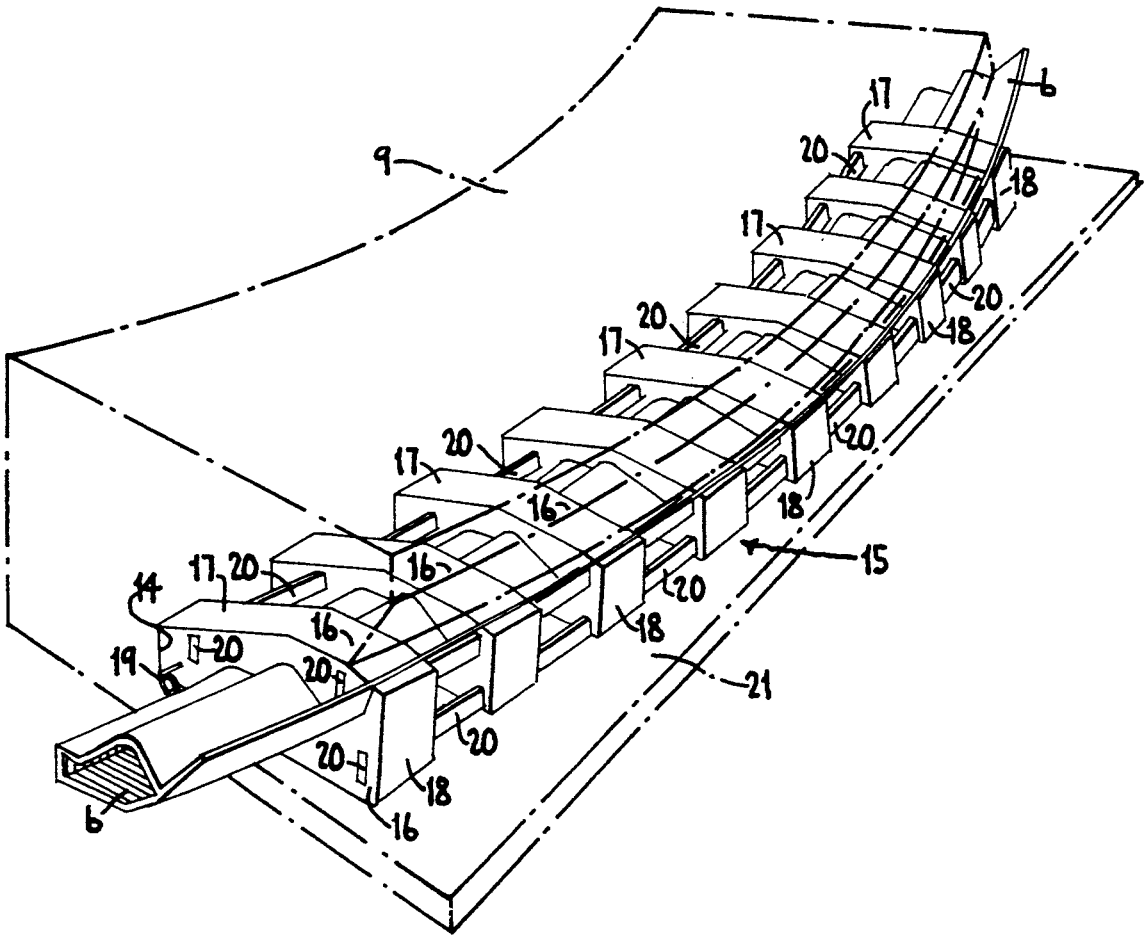
FIG. 4 is an isometric view of the preferred embodiment of the flexible constraining means used in the apparatus of this invention.

In FIGS. 3*a*, 3*b* and 4, we have illustrated a preferred embodiment of the flexible constraining apparatus of this invention. In FIGS. 3*a*, 3*b* and 4, the forming die member 9 of the stretch forming apparatus 1, illustrated generally in FIGS. 1 and 2, is provided with a die face portion 13 conforming to the desired curvature of the finished product and a die cavity 14 designed to receive the cross-sectional shape of the extrusion 6 and a flexible constraining means 15.

The flexible constraining means 15 of this embodiment comprises a plurality of closely spaced spring loaded clamp members 16 made of steel, aluminum, plastic or other hard material, each having a top portion 17 and a bottom portion 18 connected by a torsion spring hinge element 19. The closely spaced clamp members 16 are preferably 3 centimeters or less in width and are connected together by a plurality of flexible rods 20 made of steel or rubber which pass through the clamp members 16 form a series of interconnected closely spaced clamp members 16, spaced about 3 centimeters apart from each other and extend along those portions of the die face 13 where crimping, wrinkling or bulging of the extrusion 6 may occur or, in some cases, along substantially the full length of the die face 13 and on top of the die shelf extension 21, as shown in FIG. 4.

The clamp members 16 are designed to fit tightly around the outer periphery of the extrusion 6 and in a die cavity 14 which conforms to the exterior cross section of the clamp members 16 when closed on the extrusion 6, as best illustrated in FIG. 3*b*.

The closely spaced clamp members 16 and the flexible connecting rods 20 allow the constraining means 15 to flex and rotate slightly during the stretch forming operation and the movement of the die member 9, and still provide considerable exterior support to the walls of the extrusion 6. While we have illustrated the use of four rectangular flexible connecting rods 20, the rods 20 could be more or less in number and of a different cross-sectional shape if desired.

After the extrusion 6 has been reshaped to the desired contour conforming to the shape of the die face portion 13, the air pressure within the interior of the extrusion 6 is increased and causes the walls and exterior of the extrusion 6 to conform exactly to the internal shape of clamp members 16 without producing any wrinkles, crimps or bulges on the finished reformed extrusion 6.

The air pressure within the interior of the extrusion 6 is then reduced to atmospheric and the tension on the ends of the extrusion 6 released. The flexible constraining means 15 is then removed from the die cavity 14 and the clamp members 16 spring open around the torsion spring elements 19. The reformed extrusion 6 can then be removed from between the top portion 17 and bottom portion 18 of the flexible constraining means 15.

It is understood that this embodiment is just an example of the flexible constraining apparatus of this invention and is provided for the purposes of illustrating this invention and not for the purpose of limitation.

We claim:

1. Apparatus for the stretch forming of an elongated hollow metal section into a predetermined contour, comprising means to grip the opposed ends of said elongated hollow metal section and tension said elongated hollow metal section above its elastic limit, a forming die member having a rigid forming die face and a die cavity in said die face and a flexible constraining means substantially surrounding the outer periphery of said elongated hollow metal section at closely spaced intervals along the length thereof and adapted to constrain the external surfaces of said hollow metal section while both said elongated hollow metal section and said flexible constraining means are contained in said die cavity during the stretch forming of the elongated hollow metal section, said flexible constraining means having means for engaging said die cavity during said stretch forming operation and for supporting the elongated metal section so that the elongated metal section does not contact the die cavity.

2. The apparatus of claim 1 in which said flexible constraining means comprises a plurality of closely spaced clamp members.

3. The apparatus of claim 1 in which said flexible constraining means comprises a plurality of closely spaced spring loaded clamp members.

4. The apparatus of claim 1 in which said flexible constraining means comprises a plurality of closely spaced clamp members connected by flexible rods.

5. The apparatus of claim 1 in which said flexible constraining means extends along those portions of the forming die face where crimping, wrinkling or bulging of said metal section may occur.

6. The apparatus of claim 1 in which said flexible constraining means fits into a recess formed in said forming die member.

7. The apparatus of claim 1 having means to introduce a fluid under pressure into the interior of said elongated hollow metal section to force the walls of said metal section against said flexible constraining means.

8. A method for the stretch forming of an elongated hollow metal section comprising the steps of inserting at least a portion of said metal section in a flexible constraining means substantially surrounding at least a portion of the outer periphery of said metal section at closely spaced intervals along the length thereof and inserting said flexible constraining means and said metal section in a die cavity formed in a rigid die member with said flexible constraining means engaging said die cavity, gripping the opposed ends of said metal section, applying a tension to said gripped metal section above its elastic limit and reshaping said metal section while said metal section is constrained by said flexible constraining means and said flexible constraining means engages said die cavity without the metal section contacting the die cavity.

9. The method of claim 8 in which said metal section is reshaped initially by said die member and further reshaped by air at greater than atmospheric pressure.

10. The method of claim 8 in which said flexible constraining means is hinged to facilitate the insertion of said portion of the outer periphery of said metal section into said flexible constraining means.

* * * * *